US005527568A

United States Patent [19]

Boone et al.

[11] Patent Number: 5,527,568

[45] Date of Patent: Jun. 18, 1996

[54] COMBINATION BULLETIN AN DRY-ERASE MESSAGE BOARD

[75] Inventors: Michael K. Boone, Laguna Beach; Bradley C. Davis, Irvine; Brett R. Moody, Costa Mesa, all of Calif.

[73] Assignee: Boone International, Inc., Corona, Calif.

[21] Appl. No.: 363,649

[22] Filed: Dec. 22, 1994

[51] Int. Cl.[6] ..... G09F 15/00

[52] U.S. Cl. ..... 428/14; 428/455; 428/904.4

[58] Field of Search ..... 428/14, 455, 904.4, 428/13

[56] References Cited

U.S. PATENT DOCUMENTS

| | | | |
|---|---|---|---|
| D. 285,578 | 9/1986 | Habermehl | D20/42 |
| 2,202,682 | 3/1939 | Arberry | 434/425 |
| 3,755,053 | 8/1973 | Lindahl | 428/14 X |
| 4,133,123 | 1/1979 | Anderson | 40/611 X |
| 4,138,523 | 2/1979 | Matsurayama et al. | 428/323 X |
| 5,085,002 | 2/1992 | Lee et al. | 428/14 X |
| 5,099,594 | 3/1992 | Reas et al. | 40/593 |
| 5,295,342 | 3/1994 | Roche et al. | 428/14 X |

*Primary Examiner*—Henry F. Epstein
*Attorney, Agent, or Firm*—Lyon & Lyon

[57] ABSTRACT

A message board comprising cork board or other tack penetrable material fixedly mounted on a backing of heavy cardboard or other substrate, and dry-erase laminate fixedly mounted onto the cork board. The laminate generally occupies the central portion of the board and is surrounded by the cork board allowing for convenient interaction between notes written on the laminate and notes pinned to the cork board. In addition, edging or framing is fixedly secured to the edges of the cork board and backing. The message board can also include a paper pocket retained in a cavity cutout of the cork board and backing. The paper pocket resiliently and releasably retains a pad of paper, enabling the pad to be easily replaced or the paper pocket to be easily refilled.

13 Claims, 2 Drawing Sheets

COMBINATION BULLETIN AN DRY-ERASE MESSAGE BOARD

FIELD OF THE INVENTION

This invention relates to the field of message boards and, more particularly, relates to a new and improved form of a message board utilizing a dry-erase board in combination with a cork bulletin board to facilitate communication.

BACKGROUND OF THE INVENTION

Various forms of message boards are known in the art. The conventional bulletin board, which is generally made from a cork or other tack penetrable material, has been used to pin or tack notes or other things to it. Other message boards include dry-erase boards which are essentially smaller versions of the big dry-erase boards used like blackboards (or more accurately "white" boards) in offices and elsewhere.

The dry-erase boards comprise a relatively smooth laminate coating, such as porcelain, on a backing which may be heavy cardboard or other suitable backing material, such as masonite or metal. A typical board is approximately the size of a standard piece of paper with the smooth laminate normally covering the entire surface. Messages, or other information, are written on these boards with conventional dry-erase pens. The ink from these pens can easily be wiped off with an individual's fingers, a tissue, cloth, or the like.

In addition to the foregoing, variations of these boards exist wherein the bulletin board, having an all cork facing or other penetrable material, includes a pocket with a pad of paper having the backing on the pad of paper glued into the pocket. Also, an elongated slot may be provided to hold a writing instrument.

Another variation of these boards includes a board comprising both dry-erase laminate and cork board covering the respective halves of the surface of the board. Both the laminate and the cork board are disposed on a heavy cardboard or other backing or substrate.

SUMMARY OF THE INVENTION

It is accordingly a principal object of the present invention to provide an improved message board which utilizes a bulletin board in combination with a dry-erase board and is also convenient to use.

According to an exemplary embodiment of the concepts of the present invention, a message board comprises cork board or other tack penetrable material fixedly mounted on a backing of heavy cardboard, or other substrate, and dry-erase laminate fixedly mounted onto the cork board. The laminate generally occupies the central portion of the board and is surrounded by the cork board. In addition, edging or framing is fixedly secured to the edges of the cork board and backing.

Alternatively, the message board also includes a paper pocket retained in a cavity cutout of the cork board and backing. The paper pocket releasably retains a pad of paper, enabling the pad to be easily replaced or the paper pocket to be easily refilled.

In use, notes can be written on the dry-erase laminate and easily erased, while notes can also be pinned to the cork board surrounding the laminate. The configuration of the laminate relative to the cork board allows for convenient interaction between notes written on the laminate and notes pinned to the cork board.

Further objects and advantages of the present invention will become apparent from a consideration of the drawings and ensuing description.

DESCRIPTION OF THE PREFERRED EMBODIMENT

Figure 1:
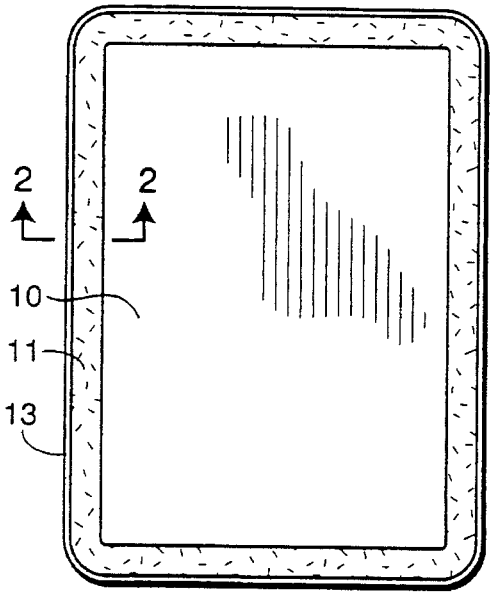
FIG. 1 is a from view of a combination bulletin board and dry-erase message board according to the present invention.

Turning now to the drawings and principally first to FIG. 1, a combination bulletin and dry-erase message board according to the present invention comprises a dry-erase surface or laminate 10 occupying the central portion of the board. The laminate 10 preferably comprises porcelain coated paper, masonite or metal. The laminate 10 is fully and evenly surrounded by a cork board 11, or some other tack penetrable material used in bulletin boards, such as synthetic cork, tile board, or fiber board, all of which may be covered by a coarse fabric if desired. The laminate 10 can be used for writing notes and messages, just like a conventional dry-erase board, whereas the cork board 11 can have notes or other things pinned to it. This configuration, in which all areas of the laminate 10 remain in relatively close proximity to the cork board 11, increases the functionality of the message board. It enables the convenient use of both mediums of communication and allows interaction between notes written on the laminate 10 and those pinned or tacked to the cork board 11, thus serving to facilitate communication and organization in the use of the message board.

Figure 2:
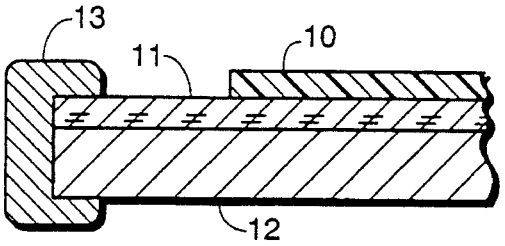
FIG. 2 is a partial cross-sectional view taken along a line 2—2 in FIG. 1.

Referring to FIG. 2, the above embodiment is preferably constructed by fixedly mounting the cork board 11 onto a heavy cardboard backing 12, or some other substrate or backing material. The laminate 10 is, in turn, fixedly mounted onto the cork board 11. Edging or framing 13 is then fixedly secured about the edges of the backing 12 and the cork board 11. The edging or frame 13 preferably comprises a vinyl wrap, but may also be constructed out of wood, injection molded plastic, or extruded aluminum.

Figure 3A:
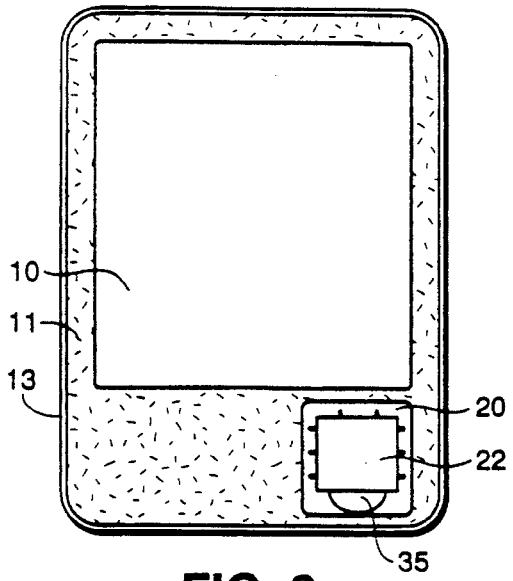
FIGS. 3A and 3B are front views of alternate embodiments of a combination bulletin board and dry-erase message board according to the present invention.
Figure 3B:
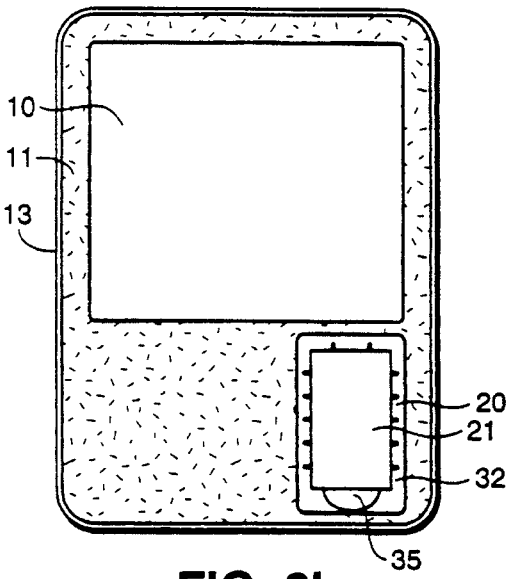

An alternate embodiment, as shown in FIGS. 3A and 3B, similarly comprises a laminate 10 surrounded by a cork board 11. However, the lower portion of the message board, which is predominately cork board 11, further includes a pocket 20 for holding a standard pad of paper 21 or a pad of Post It™ Notes 22. This configuration further serves to facilitate communication and organization enabling there to be a convenient medium on which to record a removable note. The note, thus, can either be pinned to the cork board 11 or carried away by the note taker.

Figure 4:
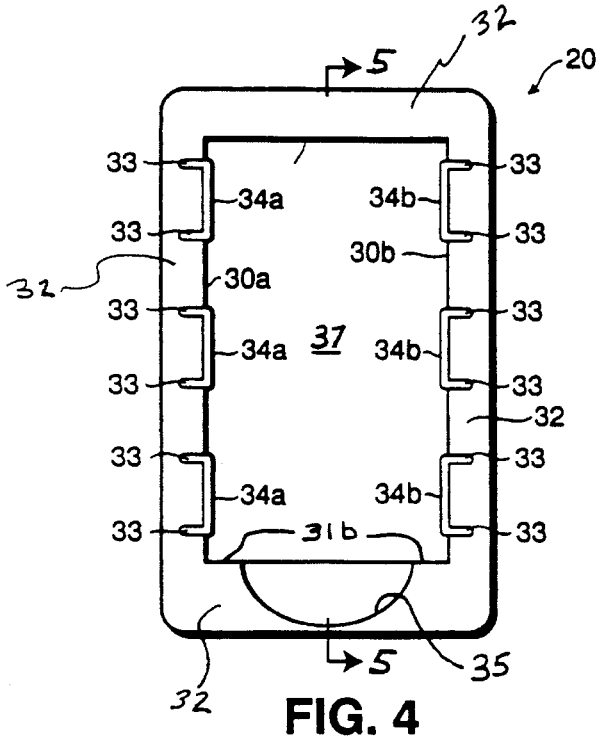
FIG. 4 is a detail of the paper pocket in FIGS. 3A and 3B.
Figure 5:
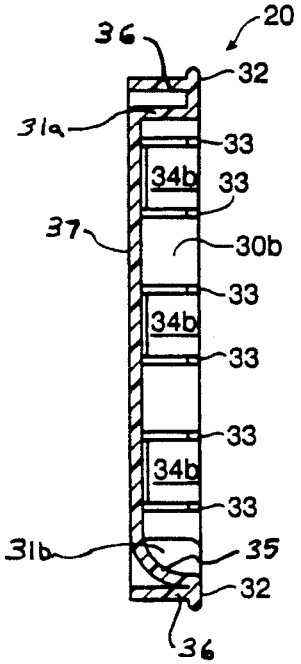
FIG. 5 is a cross-sectional view taken along a line 5—5 in FIG. 4.

As shown in FIG. 2 in the previous embodiment, the laminate 10 of FIG. 3 also is fixedly mounted to the cork board 11, which is fixedly mounted to a backing material 12 (not shown in FIGS. 3A and B). Edging 13 is also fixedly secured about the edges of the cork board 11 and backing 12. Preferably, the paper pocket 20 substantially forms an open plastic "box" as shown in FIGS. 4 and 5. The "box" includes a pair of side walls, 30*a* and 30*b*, and a pair of end walls, 31*a* and 31*b*, integrally formed along their end edges and extending into the cork 11 from the surface of the cork 11. A bottom wall 37 forms the bottom or base of the "box" and is integrally formed around its edges to the bottom edges, the edges that extend into the cork, of the side walls 30*a–b* and end walls 31*a–b*. A flange 32 extends outwardly from the top edge of the side walls 30*a–b* and end walls 31*a–b* a short distance over the surface of the cork 11 and has tabs 36 similarly extending into the cork 11 as the side walls 30*a–b* and end walls 31*a–b*. Preferably, the side walls 30*a–b*, end walls 31*a–b*, bottom wall 37, and flange 32 with tabs 36 are of one-piece molded construction. The pocket 20 fits within a cavity (not shown) cut into the cork board 11 and backing 12 with tabs 36 assisting in anchoring the pocket 20 in place.

Importantly, cavities 33 are cored into the side walls 30*a–b* and flange 32 of the pocket 20 to form substantially resilient sections or fingers 34*a* and 34*b* in the side walls 30*a–b* and flange 32. The fingers 34*a–b* releasably hold the pad 21 or 22 frictionally in place. Additionally, an arcuate cutout 35 is preferably formed in the lower end wall 30b and flange 32 to enable individual sheets of paper from the pad 21 or the Post It™ Notes 22, or the pad of paper 21 or Post It™ Notes 22 itself, to be pulled out by inserting a finger in the cutout 35. Thus, this arrangement does not require that the pad 21 or 22 be glued into a hole or cavity as in the prior art, and serves to enable the pad 21 or 22 to be replaceable or refillable.

In a further embodiment (not shown), the pocket 20 of the embodiments shown and described in FIGS. 3*a*, 3*b*, 4, and 5 could easily be added to the embodiment shown and described in FIG. 1, wherein the pocket 20 would fit into a cavity (not shown) cut into the laminate 10 and the cork 11.

Thus, the combination bulletin and dry-erase message board of the present invention provides benefits over the prior art. While the above description contains many specificities, these should not be construed as limitations on the scope of the invention, but rather as an exemplification of the preferred embodiments thereof. Other variations are possible.

Accordingly, the scope of the present invention should be determined not by the embodiments illustrated above, but by the appended claims and their legal equivalents.

What is claimed is:

1. A combination bulletin and dry-erase message board comprising a cork board, a backing fixedly attached to said cork board, framing or edging fixedly secured about the edges of said cork board and said backing, and a laminate fixedly attached to said cork board, said laminate being generally centrally located upon said cork board, with said cork board completely surrounding said laminate enabling interaction between notes written on said laminate and notes pinned to said cork board.

2. The message board of claim 1, further comprising a paper pocket extending into said cork board, said pocket being capable of releasably retaining a pad of paper.

3. The message board of claim 2, wherein said paper pocket further comprises first and second side walls, and a plurality of resilient fingers formed in said first and second side walls to resiliently and releasably retain a pad of paper.

4. The message board of claim 3, wherein said paper pocket further comprises an end wall having a flange extending therefrom, said end wall and flange having a cutout formed therein, said cutout enabling the pad of paper to be removed from said paper pocket.

5. A combination bulletin and dry-erase message board comprising a cork board, a backing fixedly attached to said cork board, framing or edging fixedly secured about the edges of said cork board and said backing, a laminate fixedly attached to said cork board, said laminate being generally centrally located upon said cork board, with said cork board completely surrounding said laminate enabling interaction between notes written on said laminate and notes pinned to said cork board, and a paper pocket extending into said cork board, said pocket being capable of releasably retaining a pad of paper.

6. The message board of claim 5, wherein said paper pocket further comprises first and second side walls, and a plurality of resilient fingers formed in said first and second side walls to resiliently and releasably retain a pad of paper.

7. The message board of claim 6, wherein said paper pocket further comprises an end wall having a flange extending therefrom, said end wall and flange having a cutout formed therein, said cutout enabling the pad of paper to be removed from said paper pocket.

8. A combination bulletin and dry-erase message board comprising a cork board, a backing fixedly attached to said cork board, framing or edging fixedly secured about the edges of said cork board and said backing, a laminate fixedly attached to said cork board, said laminate being generally centrally located upon said cork board, with said cork board completely surrounding said laminate enabling interaction between notes written on said laminate and notes pinned to said cork board, a paper pocket extending into said cork board, said pocket comprising, first and second side walls having a flange extending therefrom, first and second end walls having a flange extending therefrom, said end walls being integrally formed with said side walls, a plurality of resilient fingers formed in said first and second side walls to resiliently and releasably retain a pad of paper is said pocket, and said first end wall and flange having a cutout formed therein, said cutout enabling the pad of paper to be removed from said paper pocket.

9. A combination bulletin and dry-erase message board comprising a cork board, a laminate fixedly attached to said cork board, said laminate being generally centrally located upon said cork board, with said cork board completely surrounding said laminate enabling interaction between notes written on said laminate and notes pinned to said cork board, and a paper pocket extending into said cork board, said paper pocket being generally box-shaped and capable of releasably retaining a pad of paper.

10. The message board of claim 9, wherein said paper pocket further comprises first and second side walls, and a plurality of resilient fingers formed in said first and second side walls to resiliently and releasably retain a pad of paper.

11. The message board of claim 10, wherein said paper pocket further comprises an end wall having a flange extending therefrom, said end wall and flange having a cutout formed therein, said cutout enabling the pad of paper to be removed from said paper pocket.

12. The message board of claim 11, further comprising a backing fixedly attached to said cork board.

13. The message board of claim 12, further comprising framing or edging fixedly secured about the edges of said cork board and said backing.

* * * * *

UNITED STATES PATENT AND TRADEMARK OFFICE

CERTIFICATE OF CORRECTION

PATENT NO. : 5,527,568

DATED : June 18, 1996

INVENTOR(S) : Michael K. Boone, Bradley C. Davis, Brett R. Moody

It is certified that error appears in the above-indentified patent and that said Letters Patent is hereby corrected as shown below:

Column 2, line 7, delete the word "from" and substitute therefor the word --front--.

Signed and Sealed this

Twenty-fourth Day of September, 1996

*Attest:*

Bruce Lehman

BRUCE LEHMAN

*Attesting Officer*

*Commissioner of Patents and Trademarks*